US008806777B2

(12) United States Patent
Bassetti et al.

(10) Patent No.: US 8,806,777 B2
(45) Date of Patent: Aug. 19, 2014

(54) GOLF SHOE CLOSING DEVICE

(76) Inventors: John Adam Bassetti, Orlando, FL (US); Kenneth Bower, Elverson, PA (US)

( * ) Notice: Subject to any disclaimer, the term of this patent is extended or adjusted under 35 U.S.C. 154(b) by 588 days.

(21) Appl. No.: 13/089,137

(22) Filed: Apr. 18, 2011

(65) Prior Publication Data

US 2011/0258877 A1 Oct. 27, 2011

Related U.S. Application Data

(60) Provisional application No. 61/325,601, filed on Apr. 19, 2010.

(51) Int. Cl.
*A43C 11/00* (2006.01)
*A43B 11/00* (2006.01)

(52) U.S. Cl.
CPC ..... *A43B 11/00* (2013.01)
USPC ..... 36/50.1; 36/50.5

(58) Field of Classification Search
CPC ..... A43C 11/00; A43C 11/12; A43C 11/008; A43C 11/004
USPC ..... 36/50.1, 50.5
See application file for complete search history.

(56) References Cited

U.S. PATENT DOCUMENTS

| | | | | | |
|---|---|---|---|---|---|
| 2,637,087 | A | | 5/1953 | Forrester | |
| 2,969,573 | A | | 1/1961 | Forrester | |
| 2,978,774 | A | * | 4/1961 | Hawkins et al. | 24/438 |
| 2,987,835 | A | | 6/1961 | Forrester | |
| 3,059,351 | A | * | 10/1962 | Hawkins et al. | 36/50.1 |
| 3,078,600 | A | * | 2/1963 | Roda | 36/50.1 |
| 3,112,545 | A | * | 12/1963 | Williams | 24/390 |
| 3,122,810 | A | * | 3/1964 | Lawrence et al. | 24/438 |
| 3,999,256 | A | * | 12/1976 | MacFee | 24/438 |
| 4,104,768 | A | * | 8/1978 | Labecki | 24/438 |
| 4,631,840 | A | * | 12/1986 | Gamm | 36/50.1 |
| 5,040,274 | A | * | 8/1991 | Keech | 24/381 |
| 5,487,227 | A | | 1/1996 | Marmonier | |
| 6,173,509 | B1 | * | 1/2001 | Bowen | 36/50.1 |
| 2002/0144382 | A1 | * | 10/2002 | Bowen | 24/685 |
| 2005/0022428 | A1 | | 2/2005 | Anderson | |
| 2008/0189985 | A1 | | 8/2008 | Cox | |
| 2010/0071230 | A1 | * | 3/2010 | Hassid et al. | 36/54 |

* cited by examiner

*Primary Examiner* — Marie Bays
(74) *Attorney, Agent, or Firm* — Kenneth Bower

(57) ABSTRACT

Disclosed is a foot covering closure mechanism that converts any laced shoe to a design that requires no bending down, sitting or use of the hands to put on or take off ones shoes. The new and unique device utilizes rolling motion actuation for ease of use. Polymeric components for reliability in hostile environments, water seals to keep feet dry and adaptable fastening hardware and exterior color for compatibility with the wide variety of shoes available to the public. Other features make the mechanism easily operated by action of the opposite foot.

20 Claims, 4 Drawing Sheets

GOLF SHOE CLOSING DEVICE

CROSS-REFERENCE TO RELATED APPLICATIONS

Figure 1:
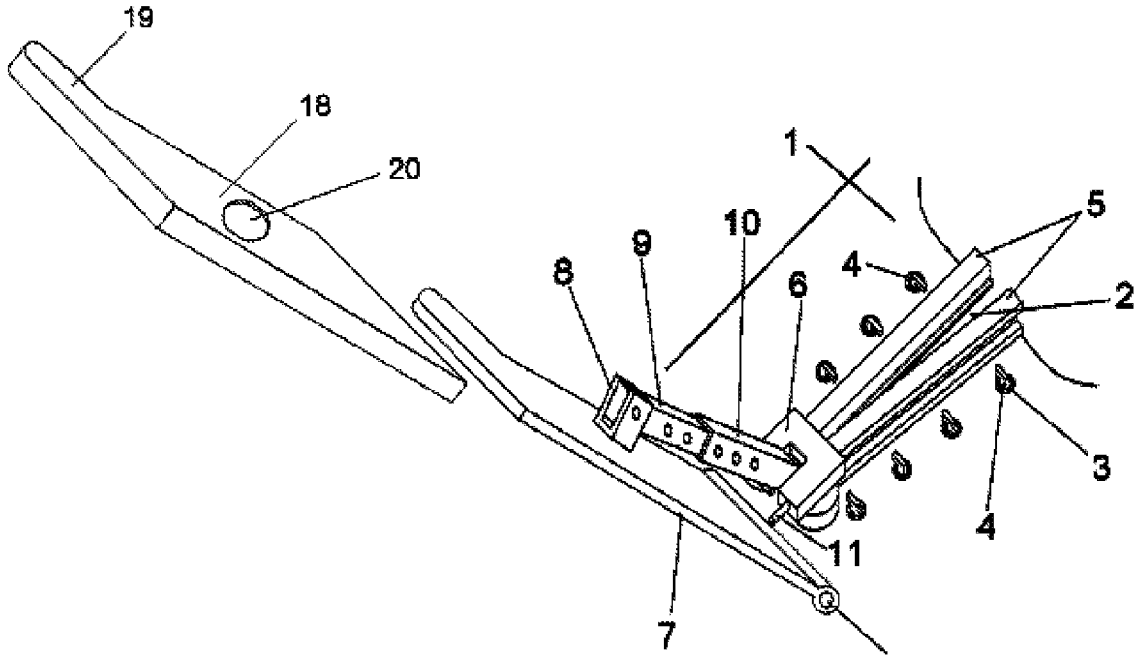

This application claims priority to U.S. Provisional Patent Application 61/325,601, filed Apr. 19, 2010.

BACKGROUND

The present invention opens and closes foot coverings without the use of the hands, bending down at the waist or even sitting. This feature is especially helpful to the over six million seniors that, the National Golf Association says, play golf in the United States. Sore backs and a loss of balance suffered by many seniors makes changing their shoes painful and even dangerous.

Golf shoes marketed 50 years ago provided a lace-less, lever operated, shoe opening and closing mechanism that still required the use of the hands combined with bending at the waist or sitting. This earlier design experienced stick slip resistance to lever operation when the shoes were new that became increasingly difficult to operate when wires rusted and dirt accumulated in the mechanism. The earlier design held promise for keeping moisture out but did not form a water seal. The earlier design had no provision for installation on shoes of varying lace eyelet spacing. The earlier design lacked provisions to open and close the shoe with the action of the opposite foot. Nor did it adapt to shoes with varying lace hole or eyelet spacing nor a means of changing exterior color to blend with the color of the shoe being converted.

PRIOR ART

The following is art representative of what is published in the field of foot covering closing devices.

The patent to Forrester (U.S. Pat. No. 2,637,087) shows a foot covering closing device with a pivoting flap, slides fastened to either side of the foot covering opening an adjustable length link between the pivoting flap and the link, However, Forrester fails to show a pivoting flap, slide with rollers engaging polymeric devices fastened to either side of the foot covering opening that adapts to shoes with varying lace hole or eyelet, a water seal across the opening when closed, an adjustable length link between the pivoting flap and the link, a pivoting flap extension for engagement with the users opposite foot and a color coordinated heat shrink sleeve covering the exterior of the pivoting flap.

The published application to Anderson (2005/0022428) shows a foot covering closing device with a pivoting flap. However, Anderson fails to show a pivoting flap, slide with rollers engaging polymeric devices fastened to either side of the foot covering opening that adapts to shoes with varying lace hole or eyelet spacing, a water seal across the opening when closed, an adjustable length link between the pivoting flap and the link, a link extension for engagement with the users opposite foot and a color coordinated heat shrink sleeve covering the exterior of the pivoting flap.

The published application to Cox (US2008/0189985) shows a foot covering closing device with a pivoting flap, and a color coordinated flap covering the exterior of the pivoting flap. However, Cox fails to show rollers engaging polymeric devices fastened to either side of the foot covering opening that adapts to shoes with varying lace hole or eyelet spacing, a water seal across the opening when closed, an adjustable length link between the pivoting flap and the link, a link extension for engagement with the users opposite foot and a heat shrink sleeve covering the exterior of the pivoting flap.

The patent to Marmonier (U.S. Pat. No. 5,487,227) shows a foot covering closing device with polymeric devices fastened to either side of the foot covering opening. However, Marmonier fails to show a pivoting flap, slide with rollers engaging polymeric devices that adapts to shoes with varying lace hole or eyelet spacing, a water seal across the opening when closed, an adjustable length link between a pivoting flap and the link, a link extension for engagement with the users opposite foot and a color coordinated heat shrink sleeve covering the exterior of the pivoting flap.

BRIEF SUMMARY OF THE INVENTION

The preferred embodiment of the present invention converts any laced shoe to a design that is easily opened and closed without the use of the hands or the need to sit or bend down. This is especially good for use by seniors.

The present invention operates the closure mechanism with rolling rather than sliding action eliminating the stick slip and affects of dirt accumulation on the ease of operation. The parts are made of polymers eliminating rust because rust accelerates difficulty of use. The closure mechanism is sealed to the shoe with sheet adhesive and also equipped with a compressible seal across the shoe opening to keep moisture from seeping in when closed. Finally the mechanism is adapted to adjust to the variety of lace hole or eyelet spacing as well as providing easily changed exterior color and therefore adapts to the wide variety of golf shoes available on the market today.

The end result of the instant invention is that the senior can choose any lace closed golf shoe that is comfortable and suits his or her comfort, performance, image or style. The instant invention is then easily installed regardless of lace eyelet spacing. The shoe is now easily opened or closed using the toe of the opposite foot. Therefore no bending down or finding a place to sit is necessary. Also, because no hands are used the hands can be used for balance reducing the danger of falling.

The primary object of the present invention is to provide a device that converts any laced foot covering to a design that is opened and closed without bending down or sitting or use of the hands.

A further object of the present invention is to provide for ease of use regardless of the condition of the opening and closing mechanism.

A further object of the present invention is to seal out moisture when the device is closed.

A further object of the present invention is to provide a single set of parts that will adapt to coloring to supplement the color of the foot covering being equipped with the device.

A further objective of the present invention is to adapt to the variations in hole or eyelet spacing found on foot coverings of differing models or manufacturers.

A further object of the present invention is to provide the aforementioned conversion without use of tools except for a source of heat.

BRIEF DESCRIPTION OF THE SEVERAL VIEWS OF THE DRAWING(S)

FIG. 1: Is a perspective view of the preferred embodiment of present invention that is in the open position.

Figure 2:
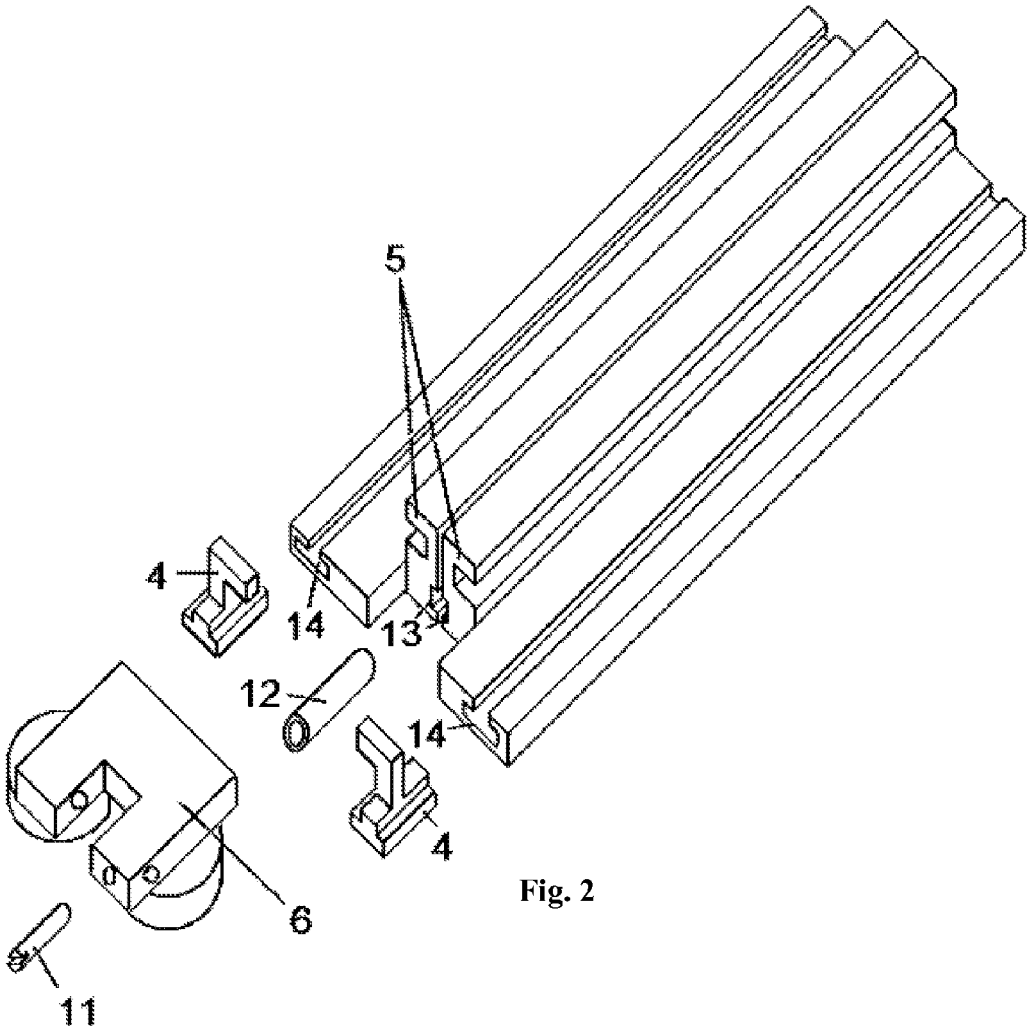

FIG. 2: Is an exploded view of the preferred embodiment of the present invention that is in the closed position.

Figure 3:
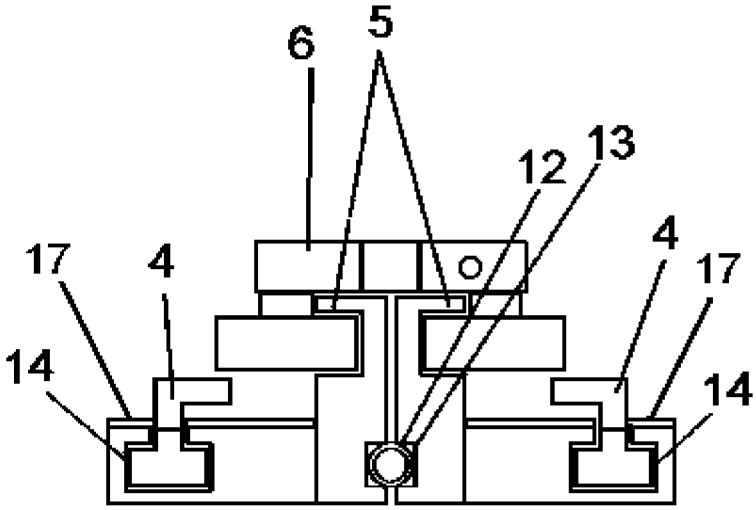

FIG. 3: Is an end view of the preferred embodiment of the present invention that is in the closed position.

Figure 4:
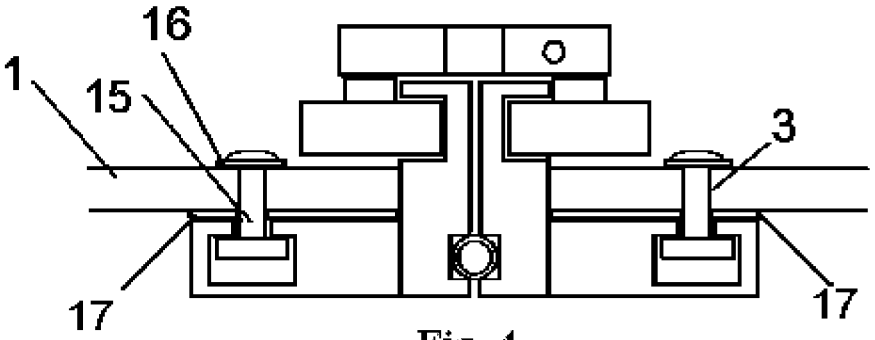

FIG. 4: Is an end view of a foot covering manufactured with the present invention installed.

Figure 5:
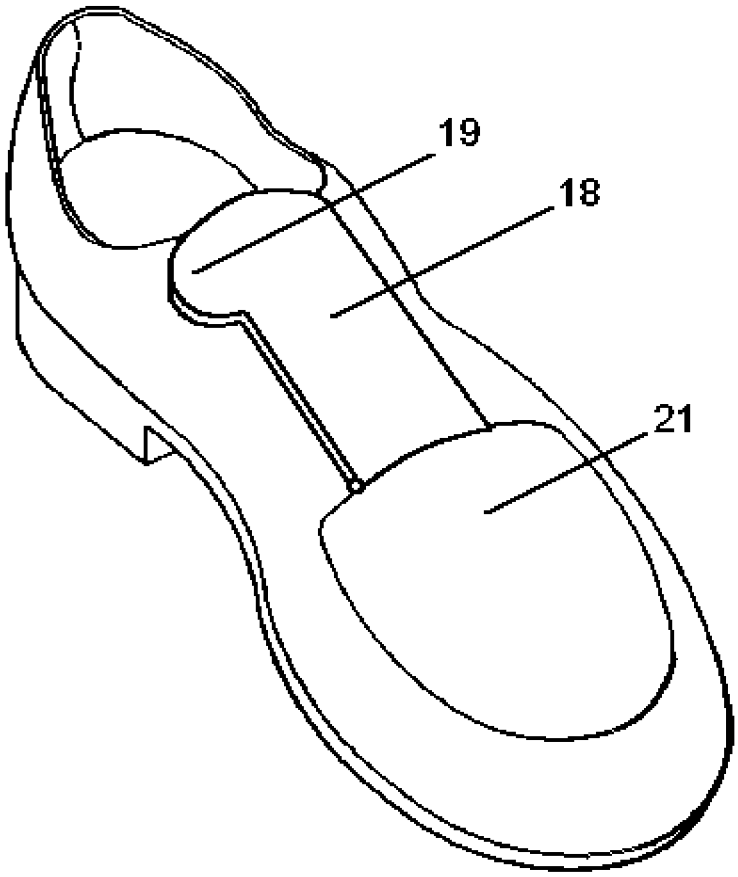

FIG. 5: Is a perspective view of the exterior of present invention installed on a golf shoe in the closed position.

DETAILED DESCRIPTION OF THE INVENTION

Referring to FIG. 1-3, The golf shoe 1 has opening 2, that is used to loosen and tighten the golf shoe 1 on the users foot (un-shown). The golf shoe 1 was originally equipped with laces (un-shown) that have been removed prior to installing the present invention. Holes or grommets 3 are engaged by hooks 4 that fasten elongated pieces 5 on either side of opening 2. Slide 6 engages the elongated pieces 5 allowing the elongated pieces 5 to separate at the top end of opening 2 when slide 6 is in the position shown in FIG. 1. Slide 6 moves the elongated pieces 5 towards each other as slide 6 is moved towards the open end of opening 2 by the user pivoting flap 7. Users pivoting of flap 7 causes yoke 8 to move upper link 9, lower link 10 thereby moving slide 6. The movement of slide 6 is limited in the direction of opening the shoe by adjustable stop 11. The movement of slide 6 is limited in the direction of closing the shoe by adjustment of the combined length of upper link 9 and loser link 10. Sleeve 18 with extension 19 fits over rotating flap 7 for protection and to add color to complement the foot covering color. In the preferred embodiment of the present invention more than one sleeve 18 of different colors may be supplied for selection before installation. The sleeve 18 is slipped over the rotating flap 7 with yoke 8 protruding through hole 20. The sleeve 18 is then shrunk to fit snuggly over rotating flap 7 by use of heat from a blow dryer or heat gun.

FIGS. 2 and 3 show features of elongated pieces 5 including slots 14 that allow hooks 4 that are engaged therein to slide in adjustment for variations in the center distance between the holes or grommets 3 of shoe 1. Grooves 13 in elongated pieces 5 accept interface part 12 which is adhered to one of the elongated pieces 5 and contacts the other elongated piece 5 when the slide 6 is moved to the far right in FIG. 2

FIG. 4 is an example of making golf shoes 1 equipped with the golf shoe closing device in the factory. The hooks 4 are replaced by rivets 15 that protrude through the holes 3 in the shoe 1. The upper end of the rivets 15 being mushroomed over washer 16 to permanently fasten the golf shoe closing device to the golf shoe 1.

FIG. 5 is a perspective view of the instant invention installed on a golf shoe 21. The rotating flap 18 and flap extension 19 are shown in the closed position.

We claim:

1. A device for opening and closing a foot covering, comprising:

a first elongated part attached to a first side of an opening of the foot covering;

a second elongated part attached to a second side of the opening of the foot covering;

a slide that moves the first elongated part and the second elongated part together when moved in a first direction for closing the opening in the foot covering;

wherein the slide allows the first elongated part and second elongated part to move apart when moved in a second direction for opening the foot covering;

a pivoting member connected to the slide for opening and closing the opening in the foot covering;

wherein the pivoting member is adapted to be moved between the first position and the second position with a users opposite foot; and one or more slots in the first elongated part and the second elongate part and a plurality of fasteners that engage the one or more of the slots and one or more of the lace holes or eyelets of the foot covering for accommodating different spacing between the lacing holes or eyelets of the foot covering.

2. The device of claim 1, further comprising:

one or more stop devices for limiting the travel of the slide.

3. The device of claim 1, further comprising:

one or more rolling members attached to the slide and engaging the first elongated part for reducing friction there between and one or more rolling member attached to the slide and engaging the second elongated part for reducing friction there between.

4. The device of claim 1, further comprising:

one or more sealants between the first elongated part and the first side of the opening and the second elongated part and the second side of the opening of the foot covering for stopping the flow of moisture.

5. The device of claim 4, wherein:

the one or more sealants is two sided sheet adhesive.

6. The device of claim 1, further comprising:

one or more compressible part separating the first elongated part and the second elongated part for blocking the flow of moisture.

7. The device of claim 6, wherein:

the one or more compressible parts is an elastomeric tube.

8. The device of claim 1, further comprising:

a link for transferring the motion of the pivoting member to the slide.

9. The device of claim 1, further comprising:

a sleeve for covering the pivoting member.

10. The device of claim 9, wherein:

the sleeve is colored for blending with foot covering colors.

11. The device of claim 8, wherein:

the length of the link is adjustable.

12. The device of claim 1, wherein the plurality of fasteners are hooks for engagement with the lace holes or eyelets intended for laces.

13. The device of claim 1, further comprising:

an extension of the pivoting member for accessibility of the user's opposite foot to rotate the pivoting member.

14. The device of claim 9, wherein:

the colored sleeve is made of a heat shrinkable material.

15. The device of claim 1, further comprising:

a sleeve for covering the pivoting member.

16. A device for opening and closing a foot covering, comprising:

a first elongated part attached to a first side of an opening of the foot covering;

a second elongated part attached to a second side of the opening of the foot covering;

a slide that moves the first elongated part and the second elongated part together when moved in a first direction for closing the opening in the foot covering;

wherein the slide allows the first elongated part and second elongated part to move apart when moved in a second direction for opening the foot covering;

a pivoting member connected to the slide for opening and closing the opening in the foot covering;

wherein the pivoting member is adapted to be moved between the first position and the second position with a user's opposite foot; and one or more rolling members attached to the slide and engaging the first elongated part for reducing friction there between and one or more rolling member attached to the slide and engaging the second elongated part for reducing friction there between.

17. The device of claim 16, further comprising:

one or more compressible part separating the first elongated part and the second elongated part for blocking the flow of moisture.

18. The device of claim 16, further comprising:

a link for transferring the motion of the pivoting member to the slide.

19. A device for opening and closing a foot covering, comprising:

a first elongated part attached to a first side of an opening of the foot covering;

a second elongated part attached to a second side of the opening of the foot covering;

a slide that moves the first elongated part and the second elongated part together when moved in a first direction for closing the opening in the foot covering;

wherein the slide allows the first elongated part and second elongated part to move apart when moved in a second direction for opening the foot covering;

a pivoting member connected to the slide for opening and closing the opening in the foot covering;

wherein the pivoting member is adapted to be moved between the first position and the second position with a user's opposite foot; and one or more sealants between the first elongated part and the first side of the opening and the second elongated part and the second side of the opening of the foot covering for stopping the flow of moisture.

20. The device of claim 19, further comprising:

one or more stop devices for limiting the travel of the slide.

* * * * *